US011400961B2

(12) United States Patent
Becher et al.

(10) Patent No.: US 11,400,961 B2
(45) Date of Patent: Aug. 2, 2022

(54) CHASSIS FOR RAIL VEHICLE

(71) Applicant: SIEMENS MOBILITY AUSTRIA GmbH, Vienna (AT)

(72) Inventors: Klemens Becher, Attendorf (AT); Thilo Hoffmann, Graz (AT); Andreas Kienberger, Graz (AT); Michael Sumnitsch, Graz (AT); Martin Teichmann, Graz (AT); Michael Zekoll, Graz (AT); Reinhard Wilding, Graz (AT)

(73) Assignee: SIEMENS MOBILITY AUSTRIA GMBH, Vienna (AT)

( * ) Notice: Subject to any disclaimer, the term of this patent is extended or adjusted under 35 U.S.C. 154(b) by 361 days.

(21) Appl. No.: 16/494,084

(22) PCT Filed: Mar. 14, 2017

(86) PCT No.: PCT/EP2017/055941

§ 371 (c)(1),
(2) Date: Sep. 13, 2019

(87) PCT Pub. No.: WO2018/166582

PCT Pub. Date: Sep. 20, 2018

(65) Prior Publication Data

US 2020/0130712 A1 Apr. 30, 2020

(51) Int. Cl.
*B61C 17/00* (2006.01)
*B61C 9/50* (2006.01)
(Continued)

(52) U.S. Cl.
CPC ..... *B61C 17/00* (2013.01); *B61C 9/50* (2013.01); *B61F 5/30* (2013.01); *B61F 5/386* (2013.01)

(58) Field of Classification Search
CPC ... B61C 17/00; B61C 9/50; B61F 5/30; B61F 5/386
See application file for complete search history.

(56) References Cited

U.S. PATENT DOCUMENTS 4,046,080 A 9/1977 Dieling et al.

FOREIGN PATENT DOCUMENTS

AT 514023 9/2014
DE 2843830 4/1980
(Continued)

OTHER PUBLICATIONS

PCT International Search Report and Written Opinion dated Dec. 7, 2017 based on PCT/EP2017/055941 filed Mar. 14, 2017.

*Primary Examiner* — Robert J McCarry, Jr.
(74) *Attorney, Agent, or Firm* — Cozen O'Connor

(57) ABSTRACT

A chassis for rail vehicles includes at least one support structure, at least one first primary spring and a second primary spring, at least one first drive motor transmission unit connected to the at least one support structure via at least one first suspension element, at least one first wheelset and at least one first clutch connected to the at least one drive motor transmission unit and to the at least first wheelset, wherein the at least first drive motor transmission unit is connected to the at least one support structure via a coupling element that is loadable primarily in the direction of a chassis longitudinal axis so as to create advantageous construction conditions such that an advantageous movability of the support structure and the first wheelset relative to each other is achieved.

14 Claims, 1 Drawing Sheet

(51) Int. Cl.
*B61F 5/30* (2006.01)
*B61F 5/38* (2006.01)

(56) References Cited

FOREIGN PATENT DOCUMENTS

| | | | | |
|---|---|---|---|---|
| EP | 0235644 | | 9/1987 | |
| EP | 0589864 | | 3/1994 | |
| EP | 0930210 | | 7/1999 | |
| WO | WO2009/056415 | | 5/2009 | |
| WO | WO-2009056415 | A1 * | 5/2009 | ..... B61C 9/50 |

* cited by examiner

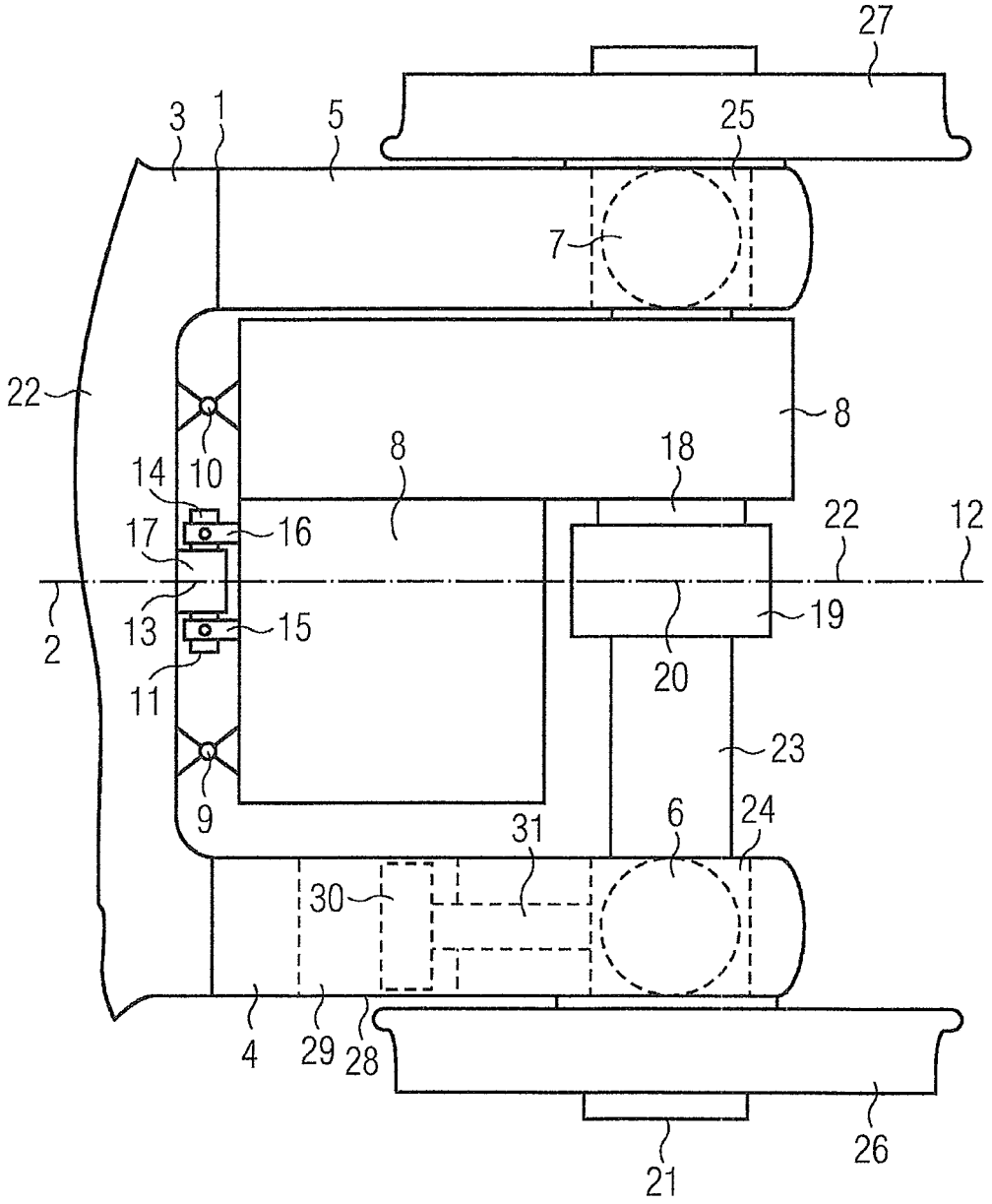
27
3
1
5
25
7
22
8
8
18
14
10
17
16
22
12
2
13
15
19
11
20
23
9
6
24
31
30
4
29
28
26
21

CHASSIS FOR RAIL VEHICLE

CROSS-REFERENCE TO RELATED APPLICATIONS

This is a U.S. national stage of application No. PCT/EP2017/055941 filed Mar. 14, 2017. The content of which is incorporated herein by reference in its entirety.

BACKGROUND OF THE INVENTION

1. Field of the Invention

The invention relates to a chassis for rail vehicles having at least one support structure, at least one first primary spring and a second primary spring, at least one first drive motor transmission unit, which is connected to the at least one support structure via at least one first suspension element, at least one first wheelset and at least one first clutch, which is connected to the at least one drive motor transmission unit and to the at least first wheelset.

2. Description of the Related Art

Chassis with different drive and transmission suspension devices as well as different coupling elements for transmitting forces and torques from drive motors and transmissions to support structures or chassis frames are known from the prior art.

EP 0 235 644 B1 discloses a chassis with a drive motor supported against a wheelset shaft and connected to a chassis frame via a linkage device. The linkage device has two steering rods. Furthermore, the drive motor is connected to a wheelset shaft via two bearings.

U.S. Pat. No. 4,046,080 further describes the principle of the "Wegmann chassis", in which a drive motor is supported on a transverse support. A support link is disposed between the drive motor, the transmission and the transverse support. Furthermore, the drive motor is connected to a longitudinal support.

AT 514023 A1 discloses a chassis for a rail vehicle in which a drive unit is supported over spring devices with elastic bodies. The drive unit is coupled to a wheelset shaft.

WO 2009/056415 A1 further discloses a bogie with a motor unit, which is connected to a bogie frame in a transversely elastic manner by way of three fastening points. Here, an axle-mounted transmission is disposed on a wheelset shaft and connected to the motor unit via a transmission torque support and a clutch.

The aforementioned conventional approaches have the disadvantage of a limited movability of the wheelset shafts or wheelsets as a function of track geometry, curve radii, track misalignments, etc. For instance, the drive motor disclosed in EP 0 235 644 B1 is supported on a wheelset shaft and increases the inertia thereof with regard to skewed rotations about a chassis vertical axis on the one hand and unsprung masses of the chassis on the other. This results in a high load on the wheelsets and significant wear on the wheels as well as a high level of vehicle noise.

Furthermore, the use of an active wheelset control with wheelset actuating devices, such as can be provided for instance to stabilize driving conditions and for ride comfort reasons, would require high actuating forces in order to effect a skewed rotation of wheelsets about a chassis vertical axis.

SUMMARY OF THE INVENTION

In view of the foregoing, it is therefore an object of the invention to provide an improved chassis compared with the prior art.

This and other objects and advantages are achieved in accordance with the invention by a chassis, in which the at least first drive motor transmission unit is connected to the at least one support structure via a first coupling element that can be loaded primarily in the direction of a chassis longitudinal axis.

While the first suspension element performs a support function with respect to the first drive motor transmission unit, primarily forces in the direction of the chassis longitudinal axis are transmitted to the support structure via the first coupling element. Support and longitudinal force transmission functions are therefore performed independently of one another. As a result, a defined application of longitudinal force to the support structure and thus a favorable force and torque curve in the supporting structure are achieved, and this in turn produces an advantageous movability of the support structure relative to the first wheelset.

Wheelset actuating devices of active wheelset controls can be compact in design. It is for example possible to provide just one wheelset actuating device per wheelset side.

It is favorable if a first cross-section surface of the first coupling element is disposed in a vertical longitudinal center plane of the at least one support structure. Here, a particularly advantageous solution is produced if the first cross-section surface is disposed centrally in the first coupling element. As a result of this measure, an approximately or exactly central application of longitudinal force from the first drive motor transmission unit to the support structure and, thus, a further improvement of the force and torque curve in the support structure is achieved. Torques that act against skewed rotations of the support structure relative to the first wheelset about a chassis vertical axis are reduced.

In a preferred embodiment, a second cross-section surface of the at least first clutch is disposed in a vertical transverse center plane of the at least first wheelset. Here, it is particularly preferable if the second cross-section surface is disposed centrally in the at least first clutch. This measure results in an approximately or exactly central application of drive and braking forces or drive and braking torques from the drive motor transmission unit via the first clutch to the first wheelset. Torques that act against skewed rotations of the first wheelset relative to the support structure about a chassis vertical axis are reduced.

Rotational movements of the first wheelset about chassis vertical axes, which can be executed with low resistance because the drive motor transmission unit is not supported on the first wheelset (for example, via corresponding bearings on a wheelset shaft) and on account of the resulting low inertias of the first wheelset and low unsprung masses of the chassis, are further facilitated. In conjunction with the low unsprung masses of the chassis, this results in a reduction of mechanical loads and wear on the first wheelset and of running noises, particularly in track curves.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWING

The invention will now be described in greater detail making reference to exemplary embodiments, in which:

The FIGURE shows a top view of an exemplary embodiment of an inventive chassis, with a first drive motor transmission unit being connected in an articulated manner to a support structure and a first coupling element being provided for a longitudinal transmission of force from the first drive motor transmission unit to the support structure.

DETAILED DESCRIPTION OF THE EXEMPLARY EMBODIMENTS

A section of an exemplary embodiment of an inventive chassis for a rail vehicle, shown in the FIGURE in a top view, comprises a support structure 1 formed as a chassis frame with a transverse support 3 and a first longitudinal support 4 and a second longitudinal support 5. In accordance with the invention, different embodiments of support structures 1 are conceivable in terms of geometry, connection technology, or materials.

The support structure 1 can be formed as a single part or as multiple parts. In multi-part embodiments, it is for instance possible to connect individual parts with one another in an articulated manner, etc. The chassis also has a transversely disposed drive motor and a transmission, which are connected via a shared housing to a first drive motor transmission unit 8.

A first wheelset 21 is coupled via a first wheelset bearing to a first wheelset bearing housing 24, a second wheelset bearing to a second wheelset bearing housing 25, and wheelset guidance mechanisms (not shown) to the support structure 1. The first wheelset 21 comprises a first wheel 26, a second wheel 27 and a wheelset shaft 23. The chassis has an inner bearing arrangement, the first wheelset bearing with the first wheelset bearing housing 24 and the second wheelset bearing with the second wheelset bearing housing 25 being disposed in a region between the first wheel 26 and the second wheel 27. In accordance with the invention, however, embodiments with an outer bearing arrangement are also conceivable.

Furthermore, a first primary spring 6 and a second primary spring 7 are provided between the first wheelset 21 and the support structure 1. The support structure 1 therefore has a primary suspension.

The first drive motor transmission unit 8 is supported on the support structure 1 in an articulated manner via an elastic first suspension element 9 and an elastic second suspension element 10. The first suspension element 9 and the second suspension element 10 are formed as fiber-reinforced rubber elements. In accordance with the invention, however, it is also conceivable for the first suspension element 9 and the second suspension element 10 to be formed from a metallic material.

Vertical and transverse forces in particular are transmitted from the first drive motor transmission unit 8 to the support structure 1 via the first suspension element 9 and the second suspension element 10. A transmission of forces in the direction of a chassis longitudinal axis 12 occurs only to a negligible extent.

Furthermore, exactly one elastic first coupling element 11, formed as a spherical bearing, is disposed between the first drive motor transmission unit 8 and the transverse support 3 of the support structure 1. The first coupling element 11 has a socket 17, through which a pin 14 is guided. The pin 14 has an elastomer layer in contact with the socket 17, as a result of which an oscillation damping is achieved. The pin 14 is connected to the first drive motor transmission unit 8 via screw connections via a first adapter 15 and a second adapter 16, which are connected to the first drive motor transmission unit 8.

The first coupling element 11 can be loaded radially, axially, torsionally and cardanically, but in particular in the direction of the chassis longitudinal axis 12. A first cross-section surface 13 of the first coupling element 11 lies in a vertical longitudinal center plane 2 of the support structure 1, which appears projecting in the FIGURE.

The first coupling element 11 is disposed centrally in relation to a region between the first longitudinal support 4 and the second longitudinal support 5. Forces and torques, particularly forces in the direction of the chassis longitudinal axis 12, are applied centrally to the transverse support 3 from the first drive motor transmission unit 8 via its housing and via the first coupling element 11. This produces a favorable force and torque curve in the support structure 1 and a good movability of the support structure 1 relative to the first wheelset 21.

Drive and braking forces or drive and braking torques are transmitted to the first wheelset 21 from the drive motor via the transmission and a first clutch 19 mounted via a hollow shaft 18 on the first wheelset 21. A second cross-section surface 20 of the first clutch 19 lies in a transverse center plane 22 of the first wheelset 21, which appears projecting in the FIGURE. The first clutch 19 is disposed centrally in relation to a region between ends of the first wheelset 21. Drive and braking forces or drive and braking torques from the first drive motor transmission unit 8 are therefore applied centrally to the first wheelset 21.

The transverse center plane 22 of the first wheelset 21 lies in the longitudinal center plane 2 of the support structure 1. It is however also possible, for instance, during wheelset movements, for the transverse center plane 22 to be offset from the longitudinal center plane 2 or to be skewed in relation to the longitudinal center plane 2, etc.

On account of the drive and braking forces or drive and braking torques applied centrally to the first wheelset 21, a favorable force and torque curve in the first wheelset 21 is achieved. Torques that act against skewed rotations of the first wheelset 21 about a chassis vertical axis are reduced. As a result, the first wheelset 21 has a good movability in particular in the event of skewed rotations about a chassis vertical axis, and loads and wear on the first wheelset 21 as well as running noises are reduced.

With an active wheelset control, only low actuating forces must be applied for steering angle changes of the first wheelset 21, in other words skewed rotations of the first wheelset 21 about a chassis vertical axis.

The first longitudinal support 4 has an active first wheelset actuating device 28, which is formed as a pneumatic actuator. In accordance with the invention, it is also possible for the first wheelset actuating device 28 to be formed as a hydraulic actuator, for instance. A cylinder 29, in which a piston 30 is guided, is disposed in the first longitudinal support 4 or surrounded by the first longitudinal support 4. A stamp 31 connected to the piston 30 is guided via an opening in an external region of the first longitudinal support 4 and connected to the first wheelset bearing housing 24. In accordance with the invention, it is also possible, for instance, to mount the wheelset actuating device 28 on an external side of the support structure 1.

The cylinder 29 can be filled with compressed air via compressed air lines (not shown), which connect the pneumatic actuator to a compressed air system (also not shown) of the rail vehicle, and via compressed air connections (not shown). With a pressure in the cylinder 29, a force is applied to the piston 30 and to the stamp 31 and this is transmitted via the first wheelset bearing housing 24 as an actuating force to the first wheelset 21. On account of the actuating force, the first wheelset 21 is rotated in a skewed manner about a chassis vertical axis (not shown) which appears projecting, in other words a steering angle of the first wheelset 21 is set in accordance with a track geometry. The pressure in the cylinder 29 and thus the actuating force are controlled via a control unit (not shown) of the rail vehicle in accordance with the required steering angle.

Not shown in the FIGURE is a second drive motor transmission unit that is configured to be identical to the first drive motor transmission unit 8 with respect to construction and connection technology principles. For a transmission of force from the second drive motor transmission unit to the support structure 1 in the direction of the chassis longitudinal axis 12, an elastic second coupling element is accordingly provided. The second coupling element is disposed centrally on the transverse support 3 in relation to a region between the first longitudinal support 4 and the second longitudinal support 5.

Drive and braking forces or drive and braking torques from the second drive motor transmission unit are applied by way of a second clutch to a second wheelset. The second clutch is disposed centrally in relation to a region between ends of the second wheelset. The second wheelset is configured to be identical to the first wheelset 21 with respect to construction principles and in terms of bearing and coupling technology.

In accordance with the invention, chassis with three wheelsets (e.g., for locomotives) or with just one wheelset are also conceivable, for instance.

Disposed on the second longitudinal support 5 is a second wheelset actuating device (not shown), which applies actuating forces to the second wheelset. The second wheelset actuating device is configured to be identical to the first wheelset actuating device 28 with respect to functional and construction principles.

The arrangement of the first wheelset actuating device 28 and the second wheelset actuating device is a favorable solution. In accordance with the invention, chassis with passive or semi-active wheelset guides or without active wheelset guides or wheelset actuating devices are however also conceivable.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A chassis for rail vehicles comprising:

at least one support structure;

at least one primary spring and a second primary spring;

at least one first suspension element;

at least one first drive motor transmission unit which is connected to the at least one support structure via the at least one first suspension element;

at least one first wheelset; and at least one first clutch which is connected to the at least first drive motor transmission unit and to the at least first wheelset;

wherein the at least first drive motor transmission unit is connected to the at least one support structure via a coupling element which is loadable primarily along a longitudinal axis of the chassis such that support and longitudinal force transmission functions are performed independently of one another.

2. The chassis as claimed in claim 1, wherein a first cross-section surface of the first coupling element is disposed in a vertical longitudinal center plane of the at least one support structure.

3. The chassis as claimed in claim 2, wherein the first cross-section surface is disposed centrally in the first coupling element.

4. The chassis as claimed in claim 1, wherein a second cross-section surface of the at least first clutch is disposed in a vertical transverse central plane of the at least first wheelset.

5. The chassis as claimed in claim 2, wherein a second cross-section surface of the at least first clutch is disposed in a vertical transverse central plane of the at least first wheelset.

6. The chassis as claimed in claim 3, wherein a second cross-section surface of the at least first clutch is disposed in a vertical transverse central plane of the at least first wheelset.

7. The chassis as claimed in claim 4, wherein the second cross-section surface is disposed centrally in the at least first clutch.

8. The chassis as claimed in claim 1, further comprising:

at least one first wheelset actuating device.

9. The chassis as claimed in claim 1, wherein the first coupling element comprises a spherical bearing.

10. The chassis as claimed in claim 1, wherein the first coupling element comprises a steering rod.

11. The chassis as claimed in claim 1, wherein the at least one support structure comprises a chassis frame.

12. The chassis as claimed in claim 1, wherein the at least first wheelset includes an inner bearing arrangement.

13. The chassis as claimed in claim 1, wherein the at least first wheelset includes an outer bearing arrangement.

14. The chassis as claimed in claim 1, further comprising:

a second suspension element disposed between the at least first drive motor transmission unit and the at least one support structure.

* * * * *